US006806634B2

(12) United States Patent
Bae

(10) Patent No.: US 6,806,634 B2
(45) Date of Patent: Oct. 19, 2004

(54) MASK FRAME FOR CATHODE RAY TUBE

(75) Inventor: Je-Yun Bae, Kyeongaangbuk-Do (KR)

(73) Assignee: LG.Philips Displays Korea Co., Ltd., Kumi (KR)

( * ) Notice: Subject to any disclaimer, the term of this patent is extended or adjusted under 35 U.S.C. 154(b) by 149 days.

(21) Appl. No.: 10/289,420

(22) Filed: Nov. 7, 2002

(65) Prior Publication Data

US 2003/0168961 A1 Sep. 11, 2003

(30) Foreign Application Priority Data

Mar. 5, 2002 (KR) ..... 2002-11480

(51) Int. Cl.[7] ..... H01J 29/81; H01J 29/07
(52) U.S. Cl. ..... 313/407; 313/402
(58) Field of Search ..... 313/402, 407

(56) References Cited

U.S. PATENT DOCUMENTS 4,806,820 A * 2/1989 Berner et al. ..... 313/407
5,742,116 A 4/1998 Maki et al. ..... 313/402
6,215,237 B1 * 4/2001 Tsuchida et al. ..... 313/402
6,268,288 B1 7/2001 Hautala et al. ..... 438/680
6,274,974 B1 * 8/2001 Ito et al. ..... 313/402
6,388,373 B1 5/2002 Nah ..... 313/474

* cited by examiner

*Primary Examiner*—Ashok Patel
*Assistant Examiner*—Mariceli Santiago
(74) *Attorney, Agent, or Firm*—Birch, Stewart, Kolasch & Birch, LLP

(57) ABSTRACT

In a mask frame for a cathode ray tube in accordance with the present invention, by satisfying $0.80 \leqq a/(Xd/4)+b/(Yd/4)+c/(Dd/4) \leqq 1.25$, herein, Xd is a long side length of the mask frame, Yd is a short side length thereof, Dd is a diagonal length thereof, a is a height of the center of the long side thereof, b is a height of the center of the short side thereof, and c is a height of the corner portion, assembly can be facilitated, howling and drop characteristics can be improved, a width of a panel can be reduced, and accordingly the cathode ray tube can be slimed down and light-weighted.

6 Claims, 6 Drawing Sheets

MASK FRAME FOR CATHODE RAY TUBE

BACKGROUND OF THE INVENTION

1. Field of the Invention

The present invention relates to a cathode ray tube, and in particular to a mask frame for a cathode ray tube which is capable of improving howling characteristics and drop characteristics by having an optimum design shape.

2. Description of the Prior Art

In general, a cathode ray tube includes a vacuous vessel consisting of a panel and a funnel. In the cathode ray tube, an electron beam emitted from an electron gun is deflected by a deflection yoke, passes plural electron beam passage holes formed at a shadow mask and lands onto a fluorescent surface formed onto the inner surface of the panel, and accordingly a picture is displayed by each luminescent material of the fluorescent surface.

The cathode ray tube will be described with reference to accompanying drawings.

FIG. 1 is a schematic view illustrating the conventional cathode ray tube.

As depicted in FIG. 1, in the conventional cathode ray tube, a panel 1 as a front glass combines with a funnel 2 as a rear glass, and the internal space is sealed in a high vacuum state.

In more detail, the cathode ray tube includes the fluorescent surface 13 coated onto the inner surface of the panel 1 and performing a certain luminary function; the electron gun 6 installed at the end of the funnel 2 and emitting the electron beam 5; the deflection yoke 7 installed at the outer circumference of the funnel 2 and deflecting the electron beam 5 so as to be scanned appropriate to a size of the fluorescent surface 13; a shadow mask 8 installed at the rear of the panel 1 with a certain distance from the fluorescent surface 13; a mask frame 9 for supporting the shadow mask 8; and an inner shield 10 installed lengthily from the panel side to the funnel side and preventing color purity deterioration due to magnetic filed influence by shielding outer earth magnetism.

The panel 1 has an almost rectangular shape. And, it consists of an effective portion 3 having the fluorescent surface 13 formed at the inner surface and a skirt portion 4 projected from the circumference of the effective portion 3 and combined with the funnel 2.

A spring supporter 14, at which a support spring 11 for elastically supporting the mask frame 9 to the panel 1 is fixed, is installed inside the skirt portion 4 of the panel 1, and a reinforcing band 12 is installed around the outer circumference of the skirt portion 4 of the panel 1 in order to reinforce the combining outer circumference between the panel 1 and the funnel 2.

As depicted in FIG. 2, the mask frame 9 includes a rectangular opening 21 formed at the inner surface to pass the electron beam 5; a bottom portion 24 consisting of two long side bottoms 22 and two short side bottoms 23; and a side portion 20 vertically extended from the bottom portion 24 to mount the shadow mask 8.

An inner shield combining hole 28 is formed at the bottom portion 24 to combine the inner shield 10 with the mask frame 9.

And, a stair-shaped bead 27 is respectively formed at regular intervals at a portion at which the bottom portion 24 meets the side portion 20 in order to improve strength of the mask frame 9.

The side portion 20 is classified into two long sides 25 and two short sides 26 according to a length, and each side is connected with each other by forming a corner portion 29.

In the above-described cathode ray tube, according to comparative increase of a width of the cathode ray tube, it is difficult to secure an installation space. In addition, a weight of the cathode ray tube is increased.

In more detail, with a recent slim-lightweight trend in cathode ray tube, using a method for reducing a width of the skirt portion 4 of the panel 1 can be considered to slim down the cathode ray tube.

In more detail, as depicted in FIG. 3A, the skirt portion 4 of the panel 1 can be reduced as a certain width ($\Delta W$). Herein, in a minimum total length of the cathode ray tube in consideration of a deflection angle of the electron beam 5, a size of the skirt portion 4 of the panel 1 can be reduced within the range of 10~15 mm.

However, as depicted in FIG. 3B, when the conventional mask frame 9 is applied as it is to the panel 1 having the reduced skirt portion 4, because a margin between the end of the mask frame 9 and the inner surface of the panel 1 is decreased, mutual interference may be occurred, by the interference, in fabrication process of the cathode ray tube, the panel 1 may be scratched or damaged.

Accordingly, in order to prevent the interference, a height of the side portion 20 of the mask frame 9 is reduced, by the height reduction of the side portion 20, because an area of the combining surface of the shadow mask 8 and the mask frame 9 is reduced, a combining force is lowered, and accordingly howling characteristics and drop characteristics of the shadow mask 8 may be deteriorated.

Accordingly, in order to apply the skirt portion 4 of the panel 1 to the reduced cathode ray tube appropriately, designing an optimum mask frame shape which is capable of satisfying howling characteristics and drop characteristics of the shadow mask 8 is required.

SUMMARY OF THE INVENTION

In order to solve the above-mentioned problem, it is an object of the present invention to provide a mask frame for a cathode ray tube which is capable of preventing interference between the inner surface of a panel and a mask frame due to decrease of an interval between them according to sliming-down of a panel and improving howling characteristics and drop characteristics of the cathode ray tube by having an optimum shape.

In order to achieve the above-mentioned object, in a cathode ray tube comprising a panel having a fluorescent surface coated onto the inner surface, a funnel connected to the panel, a shadow mask installed with a certain interval from the fluorescent surface; and a mask frame for supporting the shadow mask, a mask frame for a cathode ray tube satisfies following equation $0.80 \leqq a/(Xd/4)+b/(Yd/4)+c/(Dd/4) \leqq 1.25$, wherein Xd is a long side length of the mask frame, Yd is a short side length thereof, Dd is a diagonal length thereof, a is a height of the center of the long side thereof, b is a height of the center of the short side thereof, and c is a height of the corner portion thereof.

BRIEF DESCRIPTION OF THE DRAWINGS

The accompanying drawings which are included to provide a further understanding of the invention and incorporated in and constitute a part of this specification, illustrate embodiments of the invention and together with the description serve to explain the principles of the invention.

In the drawings.

DETAILED DESCRIPTION OF THE PREFERRED EMBODIMENT

Hereinafter, the preferred embodiment of a mask frame for a cathode ray tube in accordance with the present invention will be described with reference to accompanying drawings.

Figure 1:
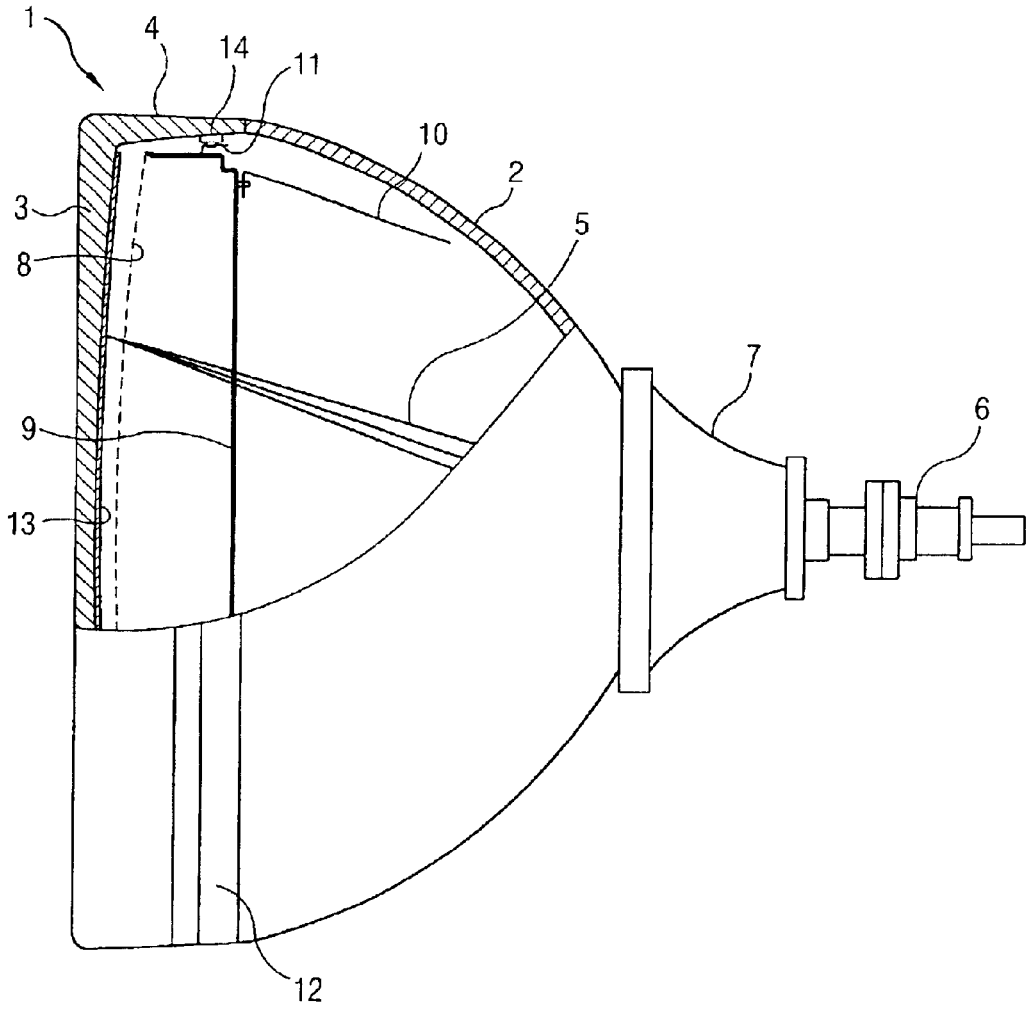
FIG.1 CONVENTIONAL ART
FIG. 1 is a schematic view illustrating the conventional cathode ray tube.
Figure 2:
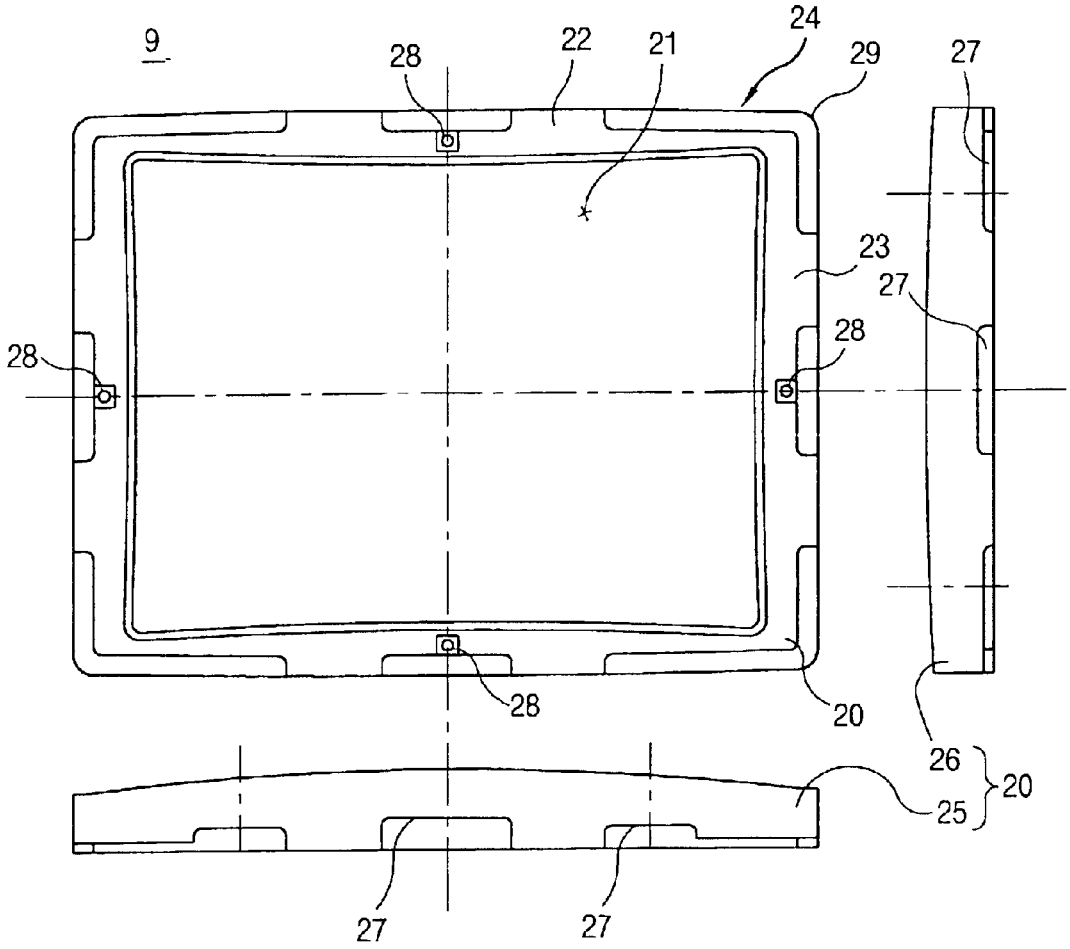
FIG. 2 CONVENTIONAL ART
FIG. 2 is a development view illustrating a mask frame of the cathode ray tube in FIG. 1.
Figure 3A:
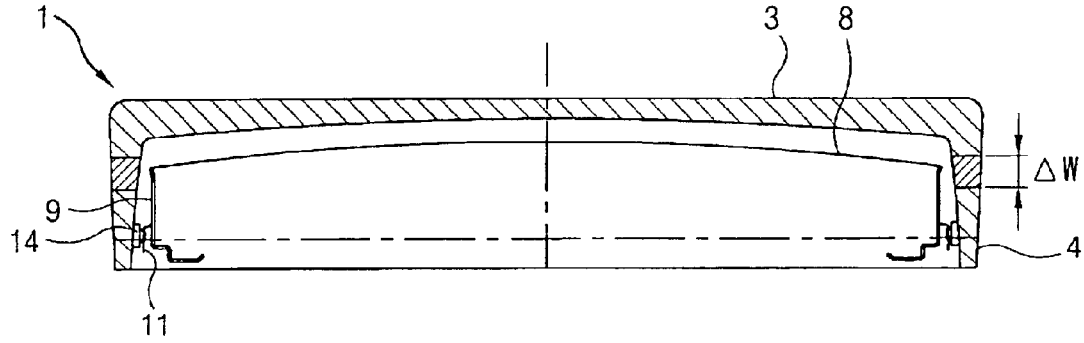
FIG.3A CONVENTIONAL ART
FIG. 3A is a sectional view illustrating a panel of the cathode ray tube in FIG. 1.
Figure 3B:
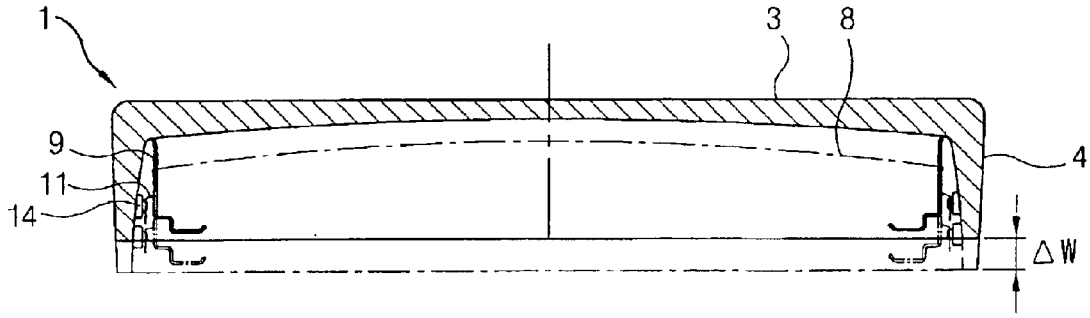
FIG.3B CONVENTIONAL ART
FIG. 3B is a sectional view illustrating width reduction of the panel of the cathode ray tube in FIG. 1.
Figure 4:
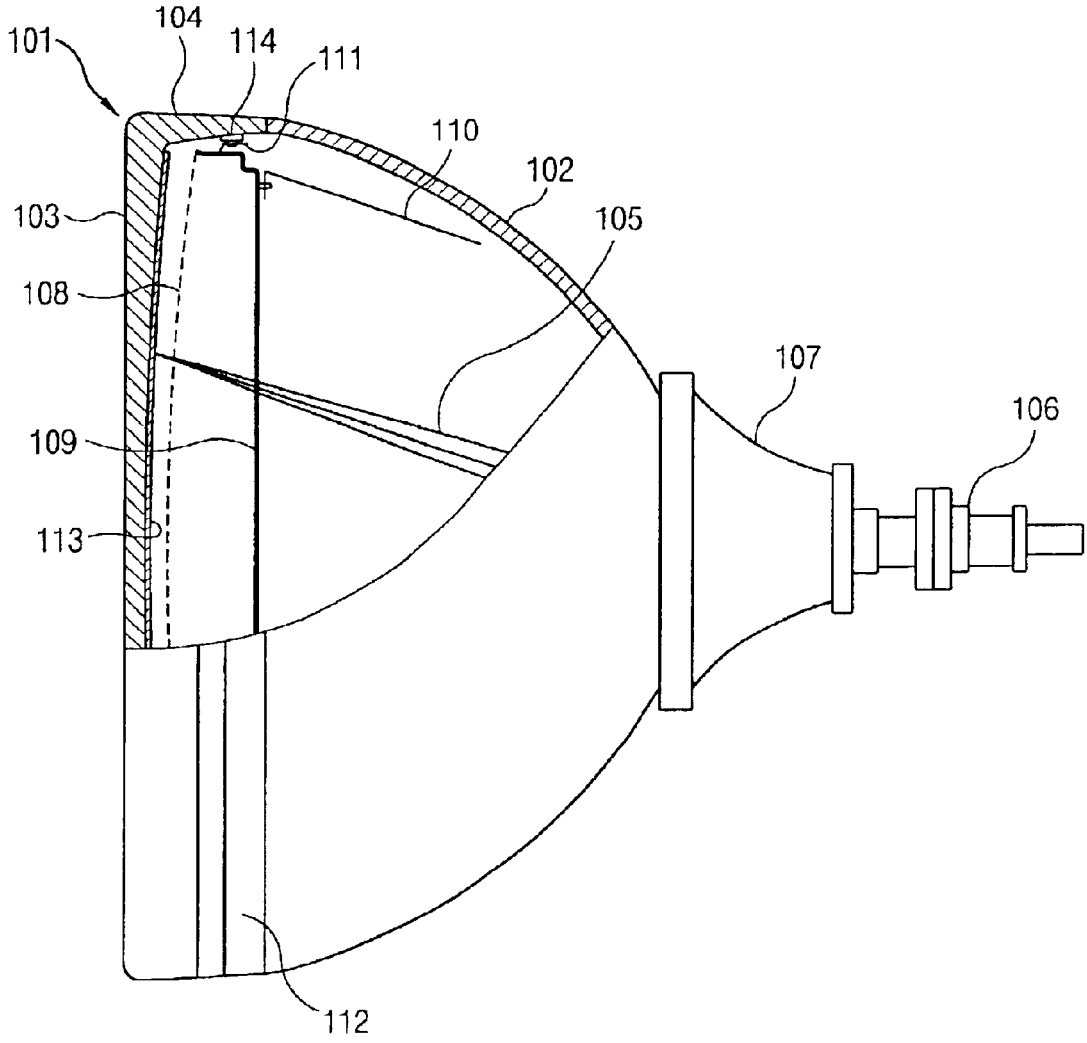
FIG. 4 is a schematic view illustrating a cathode ray tube in accordance with the present invention.
Figure 5:
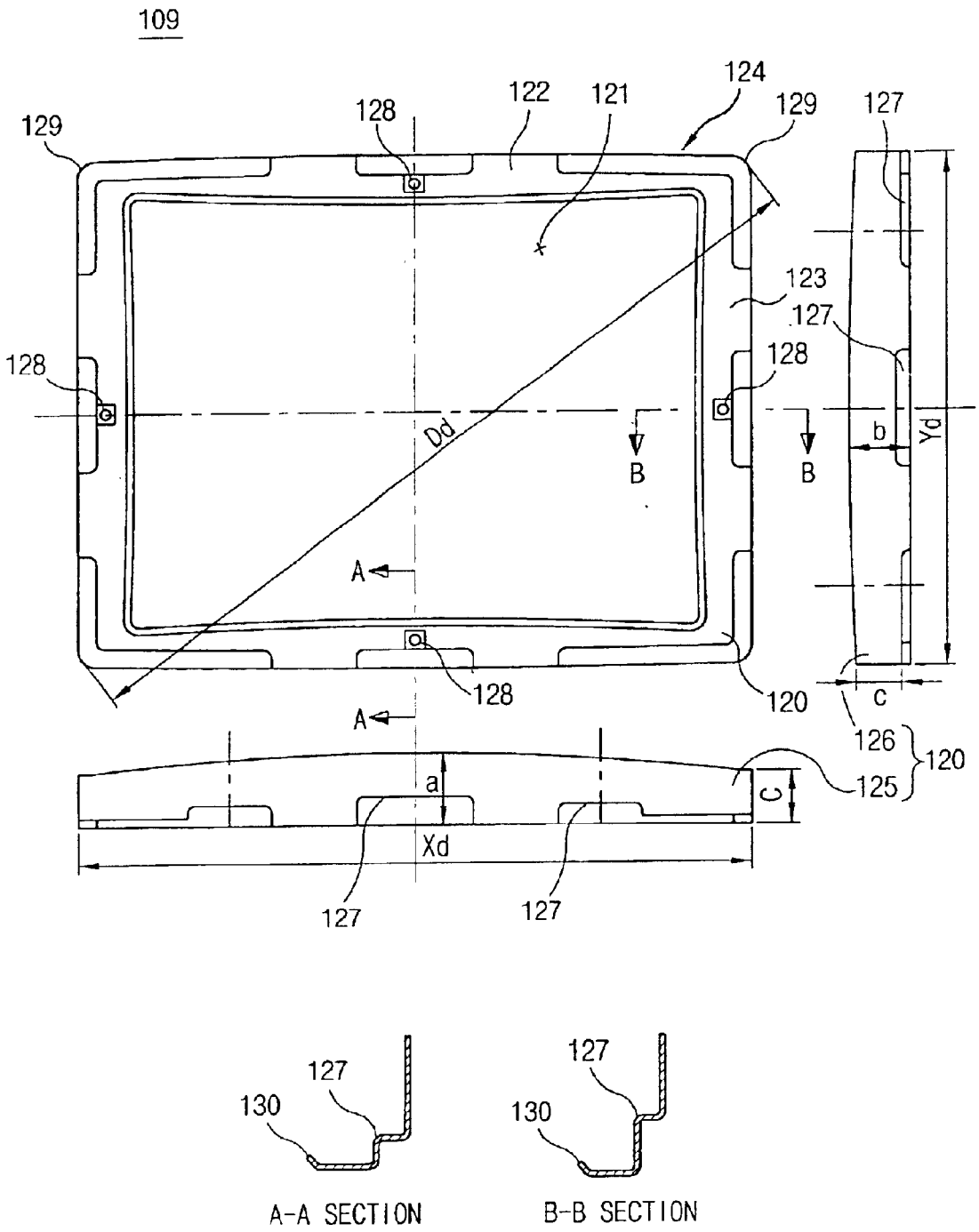
FIG. 5 is a development view illustrating a mask frame of the cathode ray tube in accordance with the present invention.

FIG. 4 is a schematic view illustrating a cathode ray tube in accordance with the present invention, and FIG. 5 is a development view illustrating a mask frame of the cathode ray tube in accordance with the present invention.

As depicted in FIG. 4, in the cathode ray tube in accordance with the present invention, a panel 101 as a front glass combines with a funnel 102 as a rear glass, and the inner space is sealed as a high vacuum state.

And, the cathode ray tube includes a fluorescent surface 113 coated onto the inner surface of the panel 101 and performing a certain luminary function; an electron gun 106 installed at the end of the funnel 102 and emitting an electron beam 105; a deflection yoke 107 installed at the outer circumference of the funnel 102 and deflecting the electron beam 105 so as to be scanned appropriate to a size of the fluorescent surface 113; a shadow mask 108 installed at the rear of the panel 101 with a certain distance from the fluorescent surface 113; a mask frame 109 for supporting the shadow mask 108; and an inner shield 110 installed lengthily from the panel side to the funnel side and preventing color purity deterioration due to magnetic filed influence by shielding outer earth magnetism.

The panel 101 has an almost rectangular shape and having a curved inner surface and a substantially flat outer surface. And, it consists of an effective portion 103 having the fluorescent surface 113 formed at the inner surface and a skirt portion 104 projected from the circumference of the effective portion 103 and combined with the funnel 102.

In addition, a spring supporter 114, at which a support spring 111 for elastically supporting the mask frame 109 to the panel 101 is fixed, is installed inside the skirt portion 104 of the panel 101, and a reinforcing band 112 is installed around the outer circumference of the skirt portion 104 of the panel 101 in order to reinforce the combining outer circumference of the panel 101 and the funnel 102.

As depicted in FIG. 5, the mask frame 109 includes a rectangular opening 121 formed at the inner surface to pass the electron beam 105; a bottom portion 124 consisting of two long side bottoms 122 and two short side bottoms 123; a side portion 120 vertically extended from the bottom portion 124 to mount the shadow mask 108 on the inner side surface; a curved portion 130 curved from the bottom portion 124 at a certain angle in order to prevent the fluorescent surface 113 from being influenced by diffused reflection of the electron beam 105; an inner shield combining hole 128 formed at the bottom portion 124 to combine the inner shield 10 for reducing outer magnetic field influence with the mask frame 109; and a stair-shaped bead 127 respectively formed at regular intervals at a portion at which the bottom portion 124 meets the side portion 120 in order to improve strength of the mask frame 109.

The side portion 120 is classified into two long sides 125 and two short sides 126 according to a length, and each long side 125 is connected with each short side 126 by forming each corner portion 129.

The cathode ray tube in accordance with the present invention has the same/similar construction as/to that of the conventional cathode ray tube.

Instead, in the cathode ray tube in accordance with the present invention, to slim down the cathode ray tube, the skirt portion 104 of the panel 101 is reduced as a certain amount in comparison with the conventional art. In more detail, an optimum design value of the mask frame which is capable of solving interference problem between the panel 101 and the mask frame 109 occurred according to width reduction of the skirt portion 104 of the panel 101 and satisfying both howling characteristics and drop characteristics of the shadow mask 108 will be described.

Herein, an optimum design value of the mask frame is presented with following equations.

$$a/(Xd/4)+b/(Yd/4)+c/(Dd/4) \quad (1)$$

In Equation 1, a is a height of the center of the long side 125 of the mask frame 109, b is a height of the center of the short side 126, c is a height of the corner portion 129, Xd is a length of the long side 125, Yd is a length of the short side 126, and Dd is a diagonal length of the mask frame 109.

In more detail, Equation (1) shows the sum of a ratio of each side height to each side length of the mask frame 109.

Accordingly, by varying a height of the side portion 120 of the mask frame 109 within the range not causing interference between the panel 101 and the mask frame 109, howling characteristics and drop characteristics of the shadow mask 108 are obtained through tests, and Tables 1 and 2 show the test results.

TABLE 1

| | Howlin Strength (kg/mm$^2$) | | | |
|---|---|---|---|---|
| a/(Xd/4) + b/(Yd/4) + c/(Dd/4) | 21 inch | 28 inch | 29 inch | 32 inch |
| 0.70 | 5 | 5 | 4 | 5 |
| 0.75 | 4 | 4 | 4 | 5 |
| 0.80 | 3 | 4 | 3 | 4 |
| 0.85 | 3 | 4 | 3 | 4 |
| 0.90 | 3 | 3 | 3 | 3 |
| 0.95 | 3 | 2 | 3 | 3 |
| 1.00 | 3 | 2 | 2 | 2 |
| 1.05 | 3 | 3 | 2 | 2 |
| 1.10 | 2 | 3 | 2 | 2 |
| 1.15 | 2 | 3 | 2 | 3 |
| 1.20 | 2 | 3 | 2 | 3 |
| 1.25 | 3 | 3 | 3 | 4 |
| 1.30 | 3 | 4 | 4 | 4 |
| 1.35 | 3 | 4 | 4 | 4 |

TABLE 1-continued

| a/(Xd/4) + b/(Yd/4) + c/(Dd/4) | Howlin Strength (kg/mm$^2$) | | | |
|---|---|---|---|---|
| | 21 inch | 28 inch | 29 inch | 32 inch |
| 1.40 | 4 | 4 | 4 | 5 |
| 1.45 | 5 | 5 | 5 | 5 |
| 1.50 | 5 | 5 | 5 | 5 |

TABLE 2

| a/(Xd/4) + b/(Yd/4) + c/(Dd/4) | Drop Strength (G) | | | |
|---|---|---|---|---|
| | 21 inch | 28 inch | 29 inch | 32 inch |
| 0.70 | 20 | 18 | 17 | 16 |
| 0.75 | 20 | 19 | 18 | 17 |
| 0.80 | 21 | 19 | 18 | 17 |
| 0.85 | 21 | 19 | 19 | 17 |
| 0.90 | 22 | 20 | 21 | 18 |
| 0.95 | 22 | 20 | 22 | 18 |
| 1.00 | 22 | 20 | 22 | 19 |
| 1.05 | 22 | 19 | 23 | 19 |
| 1.10 | 22 | 19 | 23 | 19 |
| 1.15 | 23 | 19 | 22 | 18 |
| 1.20 | 22 | 19 | 22 | 18 |
| 1.25 | 20 | 19 | 21 | 17 |
| 1.30 | 20 | 18 | 20 | 16 |
| 1.35 | 20 | 17 | 20 | 16 |
| 1.40 | 19 | 17 | 19 | 16 |
| 1.45 | 19 | 17 | 19 | 15 |
| 1.50 | 19 | 16 | 18 | 15 |

With reference to Tables 1 and 2, an optimum shape value range of the mask frame 109 satisfying both the howling characteristics and drop characteristics will be described.

When a value of Equation (1) for designing a shape of the mask frame is varied, Tables 1 and 2 respectively show a howling strength and a drop strength of the shadow mask of each 21 inch, 28 inch, 29 inch and 32 inch cathode ray tube.

In general, in the 21 inch cathode ray tube, a ½ value of a diagonal length of the effective screen of the panel is within the range of 240~270 mm. In the 28 or 29 inch cathode ray tube, a ½ value of a diagonal length of the effective screen of the panel is within the range of 315~355 mm, and in the 32 inch cathode ray tube, a ½ value of a diagonal length of the effective screen of the panel is within the range of 365~395 mm.

The howling strength value is a required value for preventing howling occurrence in the shadow mask, and the lower the howling value, the less a tensile force is required for the shadow mask.

Accordingly, the lower a required value, the more it is preferable for the optimum design of the mask frame.

In addition, the drop strength value means a limit value (power by gravity) which does not cause deformation of the shadow mask in drop impact. Herein, the higher the limit value, the more a curved surface support strength, it means the more easily the shadow mask stands impact.

Accordingly, with respect to Tables 1 and 2, in each cathode ray tube, the mask frame shape design range capable of preventing interference between the panel and the mask frame and satisfying the howling characteristics and the drop characteristics will be described.

In more detail, in the 21 inch cathode ray tube, within the range of 0.80~1.35 in Equation (1), the howling strength is 2~3 kg/mm$^2$, it can be considered as an optimum value in the howling characteristics. And, within the range of 0.80~1.20 in Equation 1, the drop strength is 21~23G, and it is advantageous in the drop characteristics in comparison with other ranges.

Accordingly, in the 21 inch cathode ray tube, the range for satisfying the howling and the drop characteristics simultaneously can be figured out as Equation (2).

$$0.80 \leqq a/(Xd/4)+b/(Yd/4)+c/(Dd/4) \leqq 1.20\{21"\} \quad (2)$$

In addition, in the 28 inch cathode ray tube, within the range of 0.90~1.25 in Equation (1), the howling strength is 2~3 kg/mm$^2$, it is advantageous in the howling characteristics. And, within the range of 0.75~1.25 in Equation (1), the drop strength is 19~20G, and it is advantageous in the drop characteristics in comparison with other ranges.

Accordingly, in the 28 inch cathode ray tube, the range for satisfying simultaneously both the howling and drop characteristics can be figured out as Equation (3).

$$0.90 \leqq a/(Xd/4)+b/(Yd/4)+c/(Dd/4) \leqq 1.25\{28"\} \quad (3)$$

In addition, in the 29 inch cathode ray tube, within the range of 0.80~1.25 in Equation (1), the howling strength is 2~3 kg/mm$^2$, it is advantageous in the howling characteristics. And, within the range of 0.90~1.25 in Equation (1), the drop strength is 21~23G, and it is advantageous in the drop characteristics in comparison with other ranges.

Accordingly, in the 29 inch cathode ray tube, the range for satisfying simultaneously both the howling and drop characteristics can be figured out as Equation (4).

$$0.90 \leqq a/(Xd/4)+b/(Yd/4)+c/(Dd/4) \leqq 1.25\{29"\} \quad (4)$$

In addition, in the 32 inch cathode ray tube, within the range of 0.90~1.20 in Equation (1), the howling strength is 2~3 kg/mm$^2$, it is advantageous in the howling characteristics. And, within the range of 0.90~1.20 in Equation (1), the drop strength is 18~19G, and it is advantageous in the drop characteristics in comparison with other ranges.

Accordingly, in the 32 inch cathode ray tube, the range for satisfying simultaneously both the howling and drop characteristics can be figured out as Equation (5).

$$0.90 \leqq a/(Xd/4)+b/(Yd/4)+c/(Dd/4) \leqq 1.20\{32"\} \quad (5)$$

In the mask frame 109 of the cathode ray tube in accordance with the present invention, when a height of the side portion 20 of the mask frame 109 is reduced according to reduction of a width of the panel 101, interference between the inner surface of the panel 101 and the end of the mask frame 109 can be prevented, and the howling and drop characteristics conditions required for the shadow mask 108 can be satisfied.

An optimum design value of the shadow mask of each size cathode ray tube will be described with reference to Tables 3~6.

In each 20 inch, 28 inch, 29 inch and 32 inch cathode ray tube, in order to design an optimum mask frame, Tables 3~6 respectively show measures of a long side length of the mask frame, a short side length thereof, a diagonal length thereof, a long side center height thereof, a short side center height thereof and a corner portion height and compare the measures with those of the conventional mask frame.

TABLE 3

| | | length (mm) | | height (mm) | | Height/ (length/4) | a/(Xd/4) + b/ (Yd/4) + c/(Dd/4) |
|---|---|---|---|---|---|---|---|
| 21" SLIM | Xd | 408.1 | a | 44 | a/(Xd/4) | 0.43 | 0.43 + 0.46 + |
| present | Yd | 310.9 | b | 36 | b/(Yd/4) | 0.46 | 0.26 = 1.15 |
| invention | Dd | 503.2 | c | 33 | c/(Dd/4) | 0.26 | |

TABLE 3-continued

| | length (mm) | | height (mm) | | Height/ (length/4) | | a/(Xd/4) + b/ (Yd/4) + c/(Dd/4) |
|---|---|---|---|---|---|---|---|
| 21" conventional art | Xd | 408.1 | a | 51 | a/(Xd/4) | 0.50 | 0.50 + 0.60 + 0.36 = 1.46 |
| | Yd | 310.9 | b | 47 | b/(Yd/4) | 0.60 | |
| | Dd | 503.2 | c | 45 | c/(Dd/4) | 0.36 | |

TABLE 4

| | length (mm) | | height (mm) | | height/ (length/4) | | a/(Xd/4) + b/(Yd/ 4) + c/(Dd/4) |
|---|---|---|---|---|---|---|---|
| 28" SLIM present invention | Xd | 571.6 | a | 55 | a/(Xd/4) | 0.38 | 0.41 + 0.42 + 0.22 = 0.97 |
| | Yd | 331.4 | b | 33 | b/(Yd/4) | 0.40 | |
| | Dd | 639.6 | c | 30 | c/(Dd/4) | 0.19 | |
| 28" conventional art | Xd | 571.8 | a | 66 | a/(Xd/4) | 0.46 | 0.46 + 0.66 + 0.31 = 1.44 |
| | Yd | 331.6 | b | 55 | b/(Yd/4) | 0.66 | |
| | Dd | 639.6 | c | 50 | c/(Dd/4) | 0.31 | |

TABLE 5

| | length (mm) | | height (mm) | | height/ (length/4) | | a/(Xd/4) + b/(Yd/ 4) + c/(Dd/4) |
|---|---|---|---|---|---|---|---|
| 29" SLIM present invention | Xd | 549.3 | a | 55 | a/(Xd/4) | 0.40 | 0.40 + 0.46 + 0.24 = 1.10 |
| | Yd | 420.5 | b | 48 | b/(Yd/4) | 0.46 | |
| | Dd | 672.2 | c | 41 | c/(Dd/4) | 0.24 | |
| 29" conventional art | Xd | 549.3 | a | 63 | a/(Xd/4) | 0.46 | 0.46 + 0.55 + 0.33 = 1.34 |
| | Yd | 420.5 | b | 58 | b/(Yd/4) | 0.55 | |
| | Dd | 672.2 | c | 55 | c/(Dd/4) | 0.33 | |

TABLE 6

| | length (mm) | | height (mm) | | height/ (length/4) | | a/(Xd/4) + b/ (Yd/4) + c/(Dd/4) |
|---|---|---|---|---|---|---|---|
| 32" SLIM present invention | Xd | 668.2 | a | 66.74 | a/(Xd/4) | 0.40 | 0.40 + 0.44 + 0.22 = 1.06 |
| | Yd | 385.6 | b | 42.87 | b/(Yd/4) | 0.44 | |
| | Dd | 744.6 | c | 40.1 | c/(Dd/4) | 0.22 | |
| 32" conventional art | Xd | 667.4 | a | 70.5 | a/(Xd/4) | 0.42 | 0.42 + 0.59 + 0.27 = 1.28 |
| | Yd | 384.8 | b | 57 | b/(Yd/4) | 0.59 | |
| | Dd | 743.8 | c | 50 | c/(Dd/4) | 0.24 | |

In more detail, as depicted in Tables 3~6, an optimum design value of the mask frame satisfying both the howling and drop characteristics is a value of Equation (1), herein a howling strength value is a minimum and a drop strength value is a maximum. In more detail, it is 1.15 in the 21 inch cathode ray tube, 0.97 in the 28 inch cathode ray tube, 1.10 in the 29 inch cathode ray tube and 1.06 in the 32 inch cathode ray tube.

The howling and drop characteristics of the mask frame for the cathode ray tube in accordance with the present invention will be described in more detail.

Figure 6:
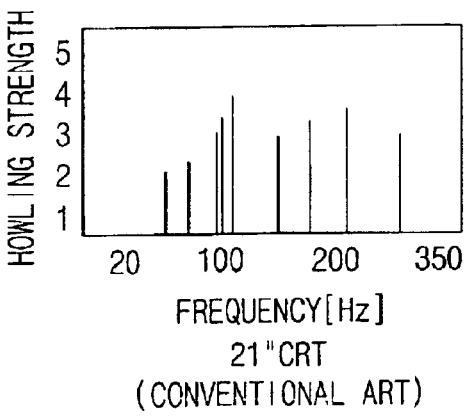
FIG. 6 is graphs respectively illustrating howling characteristics of a shadow mask of a cathode ray tube in accordance with the conventional art and the present invention.
Figure 6:
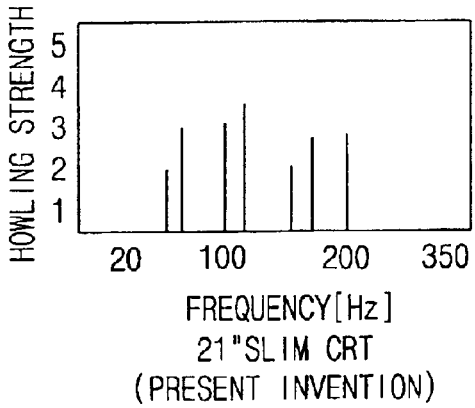
Figure 6:
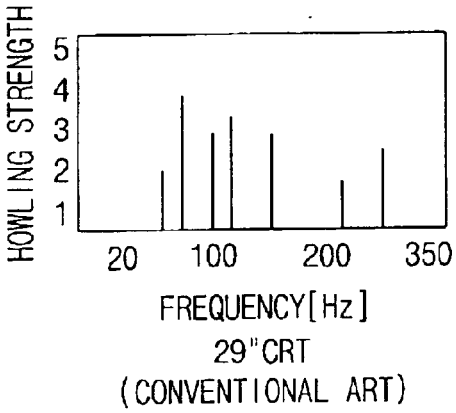
Figure 6:
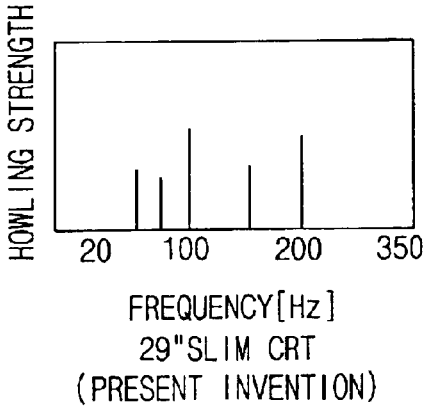

FIG. 6 is graphs respectively illustrating howling characteristics of the shadow mask of the cathode ray tube in accordance with the conventional art and the present invention, a howling frequency and occurrence frequency thereof are shown.

As shown in FIG. 6, in the 21 inch and 29 inch cathode ray tubes, the howling frequency band is varied in the range of 20 Hz~350 Hz according to strength variation of the shadow mask installed on the mask frame in accordance with the prior art. However, in the shadow mask installed on the mask frame in accordance with the present invention, the howling frequency band is in the range of 20 Hz~200 Hz.

In addition, the frequency occurrence number of the present invention is lower than that of the conventional art.

Accordingly, when the mask frame in accordance with the present invention is applied, the howling characteristics of the shadow mask in external impact can be improved.

In the meantime, when the mask frame of the cathode ray tube in accordance with the present invention is applied, the drop characteristics and advantageous thereof will be described.

In the 21 inch and 29 inch cathode ray tubes in accordance with the conventional art and the present invention, Table 7 shows limit values that the shadow mask does not be deformed by drop impact, in a case over the limit value shown in Table 7, the shadow mask may be deformed. In more detail, the higher a limit value, the higher a curved surface support strength of the shadow mask, the more easily the shadow mask stands impact.

When the drop characteristics of the mask frame in accordance with the present invention are compared with those of the conventional mask frame, the limit value is in the range of 20~22G in the conventional art. However, in the present invention, because the limit value is in the range of 22~23G, the limit value is increased as 1~3G.

TABLE 7

| | CONVENTIONAL ART | PRESENT INVENTION |
|---|---|---|
| 21" | 20~21 G | 22~23 G |
| 29" | 21~22 G | 22~23 G |

As described above, in the mask frame for the cathode ray tube in accordance with the present invention, through an optimum design of a long side length of a mask frame, a short side length thereof, a diagonal length thereof, a long side center height thereof, a short side center height thereof and a corner portion height thereof, assembly can be facilitated, howling and drop characteristics can be improved, a width of a panel can be reduced, and accordingly the cathode ray tube can be slimed down and light-weighted.

What is claimed is:

1. In a cathode ray tube comprising a panel having a fluorescent surface coated onto the inner surface, a funnel connected to the panel, a shadow mask installed with a certain interval from the fluorescent surface; and a mask frame for supporting the shadow mask, a mask frame for a cathode ray tube satisfies following equation;

$$0.80 \leqq a/(Xd/4)+b/(Yd/4)+c/(Dd/4) \leqq 1.25$$

wherein Xd is a long side length of the mask frame, Yd is a short side length thereof, Dd is a diagonal length thereof, a is a height of the center of the long side thereof, b is a height of the center of the short side thereof, and c is a height of the corner portion thereof.

2. The mask frame of claim 1, wherein the mask frame satisfies following equation $$0.80 \leqq a/(Xd/4)+b/(Yd/4)+c/(Dd/4) \leqq 1.20$$

when a ½ diagonal length of a panel effective screen of the cathode ray tube is in the range of 240~270 mm.

3. The mask frame of claim 1, wherein the mask frame satisfies following equation $$0.90 \leqq a/(Xd/4)+b/(Yd/4)+c/(Dd/4) \leqq 1.25$$

when a ½ diagonal length of the panel effective screen of the cathode ray tube is in the range of 315~355 mm.

4. The mask frame of claim 1, wherein the mask frame satisfies following equation $$0.90 \leqq a/(Xd/4)+b/(Yd/4)+c/(Dd/4) \leqq 1.20$$

when a ½ diagonal length of the panel effective screen of the cathode ray tube is in the range of 365~395 mm.

5. The mask frame of claim 1, wherein the panel has a curved inner surface and a substantially flat outer surface.

6. In a cathode ray tube comprising a panel having a substantially flat outer surface and a curved inner surface on which a fluorescent surface is coated; a funnel connected to the panel; a shadow mask installed with a certain interval from the fluorescent surface; and a mask frame for supporting the shadow mask, the mask frame for a cathode ray tube satisfies following equation;

$$0.80 \leqq a/(Xd/4)+b/(Yd/4)+c/(Dd/4) \leqq 1.25$$

wherein Xd is a long side length of the mask frame, Yd is a short side length thereof, Dd is a diagonal length thereof, a is a height of the center of the long side thereof, b is a height of the center of the short side thereof, and c is a height of the corner portion.

* * * * *